United States Patent [19]

Hanson et al.

[11] 3,991,898

[45] Nov. 16, 1976

[54] VACUUM FOIL INSULATION SYSTEM

[75] Inventors: John P. Hanson, White Oak Boro; Rudolph E. Sabolcik, Carroll Township; Robert C. Svedberg, Elizabeth Township, all of Pa.

[73] Assignee: The United States of America as represented by the United States Energy Research and Development Administration, Washington, D.C.

[22] Filed: Sept. 16, 1975

[21] Appl. No.: 613,780

[52] U.S. Cl. ..... 220/9 D; 220/63 R

[51] Int. Cl.[2] ..... B65D 25/18

[58] Field of Search ..... 220/9 C, 9 D, 10, 14, 220/63 R

[56] References Cited

UNITED STATES PATENTS

| | | | |
|---|---|---|---|
| 3,139,206 | 6/1964 | Matsch | 220/9 C |
| 3,341,052 | 9/1967 | Barthel | 220/14 |
| 3,416,693 | 12/1968 | Covington et al. | 220/9 C |
| 3,538,714 | 11/1970 | Klipping et al. | 220/14 X |

*Primary Examiner*—William Price
*Assistant Examiner*—Stephen Marcus
*Attorney, Agent, or Firm*—Dean E. Carlson; Arthur A. Churm; Paul A. Gottlieb

[57] ABSTRACT

In a multifoil thermal insulation package having a plurality of concentric cylindrical cups, means are provided for reducing heat loss from the penetration region which extends through the cups. At least one cup includes an integral skirt extending from one end of the cup to intersection with the penetration means. Assembly of the insulation package with the skirted cup is facilitated by splitting the cup to allow it to be opened up and fitted around the other cups during assembly.

3 Claims, 3 Drawing Figures

VACUUM FOIL INSULATION SYSTEM

CONTRACTUAL ORIGIN OF THE INVENTION

The invention described herein was made in the course of, or under, a contract with the UNITED STATES ENERGY RESEARCH AND DEVELOPMENT ADMINISTRATION.

BACKGROUND OF THE INVENTION

In a prior U.S. application of "Concentric Cup Multifoil Insulation", Ser. No. 513,969, filed Oct. 11, 1974, there was described a multifoil insulation package useful in an implantable nuclear powered artificial heart. The insulation consisted of a configuration of very thin nested cups which provided reduced heat loss associated with mitered corner construction at the closed end of the insulation.

The insulation package isolates a temperature controlled region from an ambient region with connection therebetween limited to some means, such as electrical wires, or tubes. Whatever the connection, a penetration through the insulation must be provided. In the prior art, the assembly of cylindrical cups is open at one end, with the penetration region extending through the opening. The open end of the assembly of cups is closed by a stack of foil washers of varying outside diameter alternating with washers of screening. The screening reduces the number of components necessary to install along the relatively long length of the penetration region and also saves weight. The stack of washers and screening forms a fluffed foil. Every so many washers are in contact and are maintained in position by the pressure from the foil cups, thereby forming a mitered joint. Difficulty in preventing heat loss from these mitered joints and in constructing the stack degrades the efficiency of the insulation.

It is therefore an object of this invention to provide an improved multifoil thermal insulation.

Another object to this invention is to eliminate the mitered joint at the penetration region end of a multifoil cylindrical thermal insulation system.

SUMMARY OF THE INVENTION

A multifoil thermal insulation system having a plurality of concentric cylindrical cups requires penetration region extending through one end of the assembly of concentric cups to allow for communication between the interior of the inculation and the ambient. Heat loss from this end of the insulation is minimized by providing at least one cup with an integral skirt extending from the side of the cup to the penetration region. Assembly of the skirted cup about the insulation package is facilited by splitting the cup in some manner to allow the cup to be opened up and fitted over the previously assembled cups. The split cup may then be closed to complete the package. The splits with an assembly having a plurality of split skirted cups, are not aligned to limit the radiation path provided by the split. Structural strength can be improved by interspersing unskirted cups in the insulation package with the skirted cups.

DETAILED DESCRIPTION OF THE INVENTION

Figure 1:
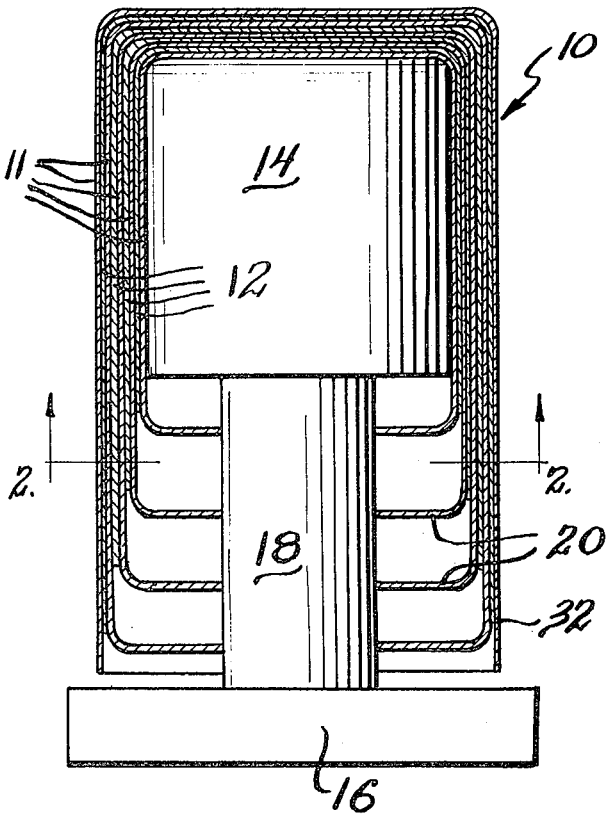
FIG. 1 shows the skirted concentric cup multifoil insulation system of the present invention.
Figure 2:
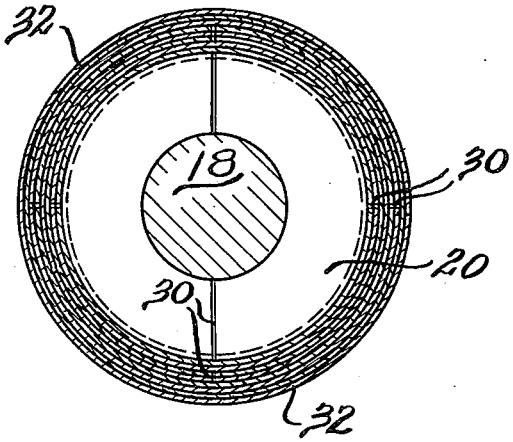
FIG. 2 is a sectional long line 2—2 of FIG. 1.

Referring to FIG. 1, and FIG. 2 the improved multifoil thermal insulation assembly 10 of the present invention is shown. Multifoil thermal insulation consists of a number of highly reflective, thin foil sheets of material or foil layers 11 separated by an interlayered standoff material 12. The foil layers are usually metal at high temperature or a metal coated plastic at low temperature. The foil layers 11 provide an effective barrier to radiation heat transfer and are operated under low pressure (less than $10^{-4}$ torr) to minimize gas convection loss. The multifoil insulation surrounds a temperature controlled region 14 allowing for communication between region 14 and ambient region 16 by penetration region 18.

In the prior art, foil washers separated by screening were stacked about the penetration region forming a fluffed foil with several of the washers mitered to individual concentric cups. Ideally, the contour of such a mitered joint should be designed so that the temperature distribution in the foil cups and in the stack exactly match the temperature gradient along the penetration region 18. This would eliminate heat conduction radially along the layers of the washers. It is very difficult to manufacture such a contoured joint. A bad contour increases the heat losses along the penetration, in addition to the losses due to the mitered joint itself. The use of the fluffed foil in this region makes the package approximately 20% heavier than it needs to be, and assembly or disassembly of such a package is extremely tedious and time consuming. The present disclosure involves an improvement in the design of the foil cups 11 eliminating the need for the fluffed foil and the mitered joints.

The mitered joints are replaced with self-supporting skirts 20 formed as an integral part of the foil cup and extending from the open end of the cup to encompass the penetration region 18. The outside diameter of the skirt varies according to the diameter of the cup of which it is an integral part. The joint between skirt 20 and cup 11 can be made to meet the ideal conditions very easily.

Fabrication of such a skirted cup is according to the method described in application Ser. No. 513,969 previously referred to. In the preferred embodiment nickel foil is used to form the concentric cups. Powered $ZrO_2$ is used as the standoff material. High-density, thin wall nickel cups may be fabricated by an electro-forming process using a nickel sulfamate plating bath and polished aluminum mandrels. The nickel is first plated on the aluminum mandrel, which is in the desired shape having an indentation machined at the bottom for forming the skirt. The nickel is then removed from the mandrel by dissolving the aluminum in hot KOH or NaOH. The electroplated nickel may then be mounted on a lathe to allow for cutting a hole in the skirted end of desired diameter to encompass the penetration region. The plasma sprayed zirconium dioxide is applied to the nickel cups prior to dissolving away the mandrel. In all other respects, the fabrication of the skirted cups follows the description of application Ser. No. 513,969.

Figure 3:
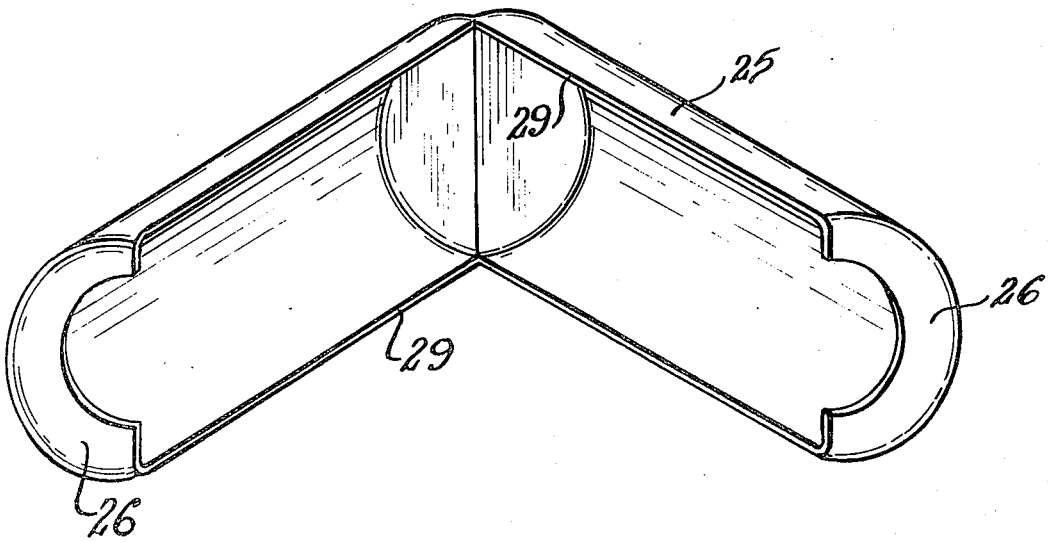
FIG. 3 shows an individual improved concentric cup for use in the multifoil insulation.

It is difficult to assemble a multifoil package with skirted cups without damaging inner cups already in place. Referring to FIG. 3, there is shown a skirted cup which minimizes the difficulty in assembly. Cup 25 with skirt 26 is split along its sides in two places 29. Such a split cup may be opened during assembly and fitted over already assembly cups and then closed about the assembled cups. Alternate split cup configurations include separating the cup in two halves, or just splitting the cup part way up the side.

The gaps where the cups are split will provide thermal radiation paths, but this heat loss can be minimized as shown in FIG. 2 by insuring that these gaps 30 do not line up between adjacent cups. To improve the structural performance of the assembly, the split skirted cups can be alternated with unskirted cups which have not been split. The skirted split cups will have less structural strength than the unskirted unsplit cups. The ratio of skirted to unskirted cups depends upon the particular design desired. The number of unskirted cups used could reasonably vary between having every other cup unskirted to having only the last outer cup being unskirted, or the unskirted cups could be eliminated altogether, relying on the walls of a vacuum vessel (not shown) to provide mechanical integrity. In FIG. 1 and FIG. 2 an unskirted cup 32 is shown being used as the outside cup for holding the assembly together. If the skirted cups are split in half, the separation along the closed end of the cup should not consist of a straight line. If this is done, the joint where the separations come together in the top plane will form a direct radiation path and decrease the effectiveness of the package.

The embodiments of the invention in which an exclusive property or privilege is claimed are defined as follows:

1. In a metal foil insulation package having a penetration region at one end to allow communication through said penetration region between the ambient surrounding said insulation package and a solid object in the interior of said insulation package, the improvement in said package for reducing heat loss from around said penetration region, comprising a plurality of cylindrical metal foil cups disposed in concentric relation with an opening at one end of each cup to allow for said penetration region, each of said plurality of cups having a skirt integral with and of the same material as said plurality of cups, each of said skirts extending from said one end of said cup towards the center of said opening, each of said skirted cups being split thereby allowing said cups to open up to facilitate assembly of said package, and at least one unskirted, unsplit metal foil cup disposed in concentric relation with said plurality of skirted, split cups.

2. The insulation package of claim 1 including a plurality of unskirted, unsplit cylindrical metal foil cups.

3. The insulation package of claim 2 wherein said metal foil cups are all of electroformed nickel.

* * * * *